US009261299B2

(12) United States Patent
Porter et al.

(10) Patent No.: US 9,261,299 B2
(45) Date of Patent: Feb. 16, 2016

(54) DISTRIBUTED MICROSYSTEMS-BASED CONTROL METHOD AND APPARATUS FOR COMMERCIAL REFRIGERATION

(75) Inventors: Michael Ramey Porter, Antioch, TN (US); Joseph James Rozsnaki, Wetumpka, AL (US); Osman Ahmed, Hawthorn Woods, IL (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 1413 days.

(21) Appl. No.: 11/786,038

(22) Filed: Apr. 10, 2007

(65) Prior Publication Data

US 2008/0072611 A1 Mar. 27, 2008

Related U.S. Application Data

(60) Provisional application No. 60/846,919, filed on Sep. 25, 2006, provisional application No. 60/846,459, filed on Sep. 22, 2006, provisional application No. 60/847,058, filed on Sep. 25, 2006.

(51) Int. Cl.

| | |
|---|---|
| ***F25B 49/02*** | (2006.01) |
| *F25B 5/02* | (2006.01) |
| *F25B 41/04* | (2006.01) |

(52) U.S. Cl.

CPC . *F25B 49/02* (2013.01); *F25B 5/02* (2013.01); *F25B 41/043* (2013.01); *F25B 2400/15* (2013.01); *F25B 2400/22* (2013.01)

(58) Field of Classification Search

CPC ..... F25B 2313/0233; F25B 5/02; F25B 2309/002; F25B 2700/00; F25B 41/04; F25B 41/062; F25B 2341/066; F25B 2341/064; F25B 49/02

USPC ..... 62/199, 200, 203–205, 225

See application file for complete search history.

(56) References Cited

U.S. PATENT DOCUMENTS

| | | | | | |
|---|---|---|---|---|---|
| 3,733,849 | A * | 5/1973 | Cantagallo et al. | ..... | 62/414 |
| 4,766,735 | A * | 8/1988 | Gotou | ..... | 62/175 |
| 5,035,119 | A * | 7/1991 | Alsenz | ..... | 62/225 |
| 5,749,238 | A * | 5/1998 | Schmidt | ..... | 62/211 |
| 5,893,271 | A * | 4/1999 | Brink | ..... | 62/93 |
| RE37,630 | E * | 4/2002 | Behr | ..... | 62/80 |
| 6,786,056 | B2 * | 9/2004 | Bash et al. | ..... | 62/199 |
| 2005/0252222 | A1 * | 11/2005 | Jessen et al. | ..... | 62/175 |
| 2005/0252984 | A1 * | 11/2005 | Ahmed | ..... | 236/51 |
| 2006/0123810 | A1 * | 6/2006 | Ha et al. | ..... | 62/149 |
| 2006/0150648 | A1 * | 7/2006 | Jang et al. | ..... | 62/200 |

* cited by examiner

*Primary Examiner* — Marc Norman

(57) ABSTRACT

An arrangement for use in a refrigeration system includes a compressor, a condenser, at least one evaporator unit, and at least one expansion valve. The arrangement includes first and second microsystems and first and second controllers. The first microsystem includes a first MEMs sensor configured to measure at least a first operational parameter of a first of the plurality of refrigeration devices. The first controller is operable to generate a first actuator control signal based on a first control signal, and is configured to generate the first control signal based directly or indirectly on the first operational parameter measurement. The second microsystem includes a second MEMs sensor configured to measure at least a second operational parameter of a second of the plurality of refrigeration devices. The second controller is operable to generate a second actuator control signal based on a second control signal, and is configured to generate the second control signal based directly or indirectly on the second operational parameter measurement.

18 Claims, 5 Drawing Sheets

DISTRIBUTED MICROSYSTEMS-BASED CONTROL METHOD AND APPARATUS FOR COMMERCIAL REFRIGERATION

This application claims the benefit of U.S. Provisional Application Ser. No. 60/846,459, filed Sep. 22, 2006, U.S. Provisional Application Ser. No. 60/847,058, filed Sep. 25, 2006, U.S. Provisional Application Ser. No. 60/846,919, filed Sep. 25, 2006, all of which are incorporated herein by reference.

CROSS-REFERENCE TO RELATED APPLICATIONS

Cross-reference is made to U.S. Patent Application Serial No. 11/786,033, filed Apr. 9, 2007, and U.S. Patent Application Ser. No. 11/786,042, filed Apr. 9, 2007.

FIELD OF THE INVENTION

The present invention relates to cooling systems, and more particularly, to commercial refrigeration systems and cooling subsystems of HVAC systems.

BACKGROUND OF THE INVENTION

Cooling systems are used for a variety of purposes, such as for refrigeration or air conditioning. One common type of cooling system is a vapor compression refrigeration system. A vapor compression refrigeration system generally includes, among other things, a compressor, a condenser, an expansion valve, and an evaporator, along with a refrigerant and a series of valves and pipes.

As is known in the art, circulating refrigerant enters the compressor where it is both pressurized and heated as a result of the pressurization. This heated vapor is then passed through the condenser which allows the vapor to dissipate heat and thus change to a liquid state. The condenser acts as a heat exchanger by rejecting the heat of the system to an external medium. The liquid refrigerant then passes through a thermostatic expansion valve (TEV or TXV). The TEV creates a substantial pressure drop causing part of the liquid refrigerant to flash evaporate. The liquid and vapor refrigerant mixture then circulates through the evaporator. While in the evaporator, the ambient air of the space to be cooled warms the refrigerant causing more of the liquid portion to evaporate thus absorbing the heat from the ambient space. Ideally, the refrigerant leaving the evaporator will be mostly vapor. This vapor then passes into back into the compressor and the cycle repeats.

One issue that arises with current cooling systems is that specific compartments or spaces may have optimal temperature and moisture requirements that differ from contiguous compartments or spaces. This arises, for instance, in refrigerated cases at the supermarket when foods having different characteristics are stored in the same case with a single controller. The operating costs of the refrigerated case may be higher than necessary because the case will have to be kept at the cooler of the competing settings to prevent food spoilage.

In addition, it is possible that some refrigeration cases require more cooling than others in order to maintain a desired temperature, even if the desired temperature is the same. Additional cooling requirements can result from external factors, such as the exposure to more ambient heat in some refrigerant cases, or placement near warmer zones of the building.

Current cooling systems are limited in their ability to maintain desired temperature in food display cases. Typical control systems for refrigeration include an evaporator pressure regulator valve that is operable to adjust pressure within the evaporator responsive to temperature measurements taken from inside the refrigerator. For example, the temperature measurement used for evaporator pressure regulation may be taken from the air exiting the evaporator (evaporator discharge air). In many cases, there are multiple evaporators connected to a single evaporate pressure regulator device. In such cases, it is not possible to regulate individual case temperature in this manner.

In alternative systems, the flow of refrigerant into an evaporator unit may be regulated responsive to a temperature measurement of the discharge air. Such systems, however, combined with other necessary control systems such as frost control, require extensive wiring and large installation costs. In many cases, the evaporator pressure regulator may be implemented as a mechanical feedback control valve. The use of mechanical feedback reduces wiring costs but is less responsive and less reliable.

Accordingly, there is need for an arrangement and/or method for controlling temperature within refrigerator cases, particularly in large systems, that overcomes the disadvantages of the prior art.

SUMMARY OF THE INVENTION

The present invention addresses the above mentioned issue by providing in one embodiment a distributed control of the refrigeration between cases and/or between compartments within a refrigeration case. One way this can be done is by implementing a feedback control arrangement with multiple evaporator subsystems, as well as other subsystems, of a single refrigeration system. The feedback control arrangement employs wireless microsystem sensors and controllers that can manipulate the pressures of the evaporators based on sensor readings to maintain or control case temperature. The feedback control arrangement may be used to control temperature, as well as other conditions, within each compartment independently.

A first embodiment of the invention is an arrangement for use in a refrigeration system that includes a compressor, a condenser, at least one evaporator unit, and at least one expansion valve. The arrangement includes first and second microsystems and first and second controllers. The first microsystem includes a first MEMs sensor configured to measure at least a first operational parameter of a first of the plurality of refrigeration devices. The first controller is operable to generate a first actuator control signal based on a first control signal, and is configured to generate the first control signal based directly or indirectly on the first operational parameter measurement. The second microsystem includes a second MEMs sensor configured to measure at least a second operational parameter of a second of the plurality of refrigeration devices. The second controller is operable to generate a second actuator control signal based on a second control signal, and is configured to generate the second control signal based directly or indirectly on the second operational parameter measurement.

Another embodiment of the invention is a distributed control arrangement for a plurality of subsystems in a cooling system. The control arrangement includes a processing circuit and at least one wireless sensor microsystem associated with each of a plurality of subsystems, for example, evaporator subsystems, in the cooling system. The control arrangement performs at least one control operation based on values received wirelessly from the wireless sensor microsystems.

Other embodiments employ distributed control systems in other aspects of a refrigeration system using Microsystems. The above described features and advantages, as well as others, will become more readily apparent to those of ordinary skill in the art by reference to the following detailed description and accompanying drawings.

DETAILED DESCRIPTION

Figure 1:
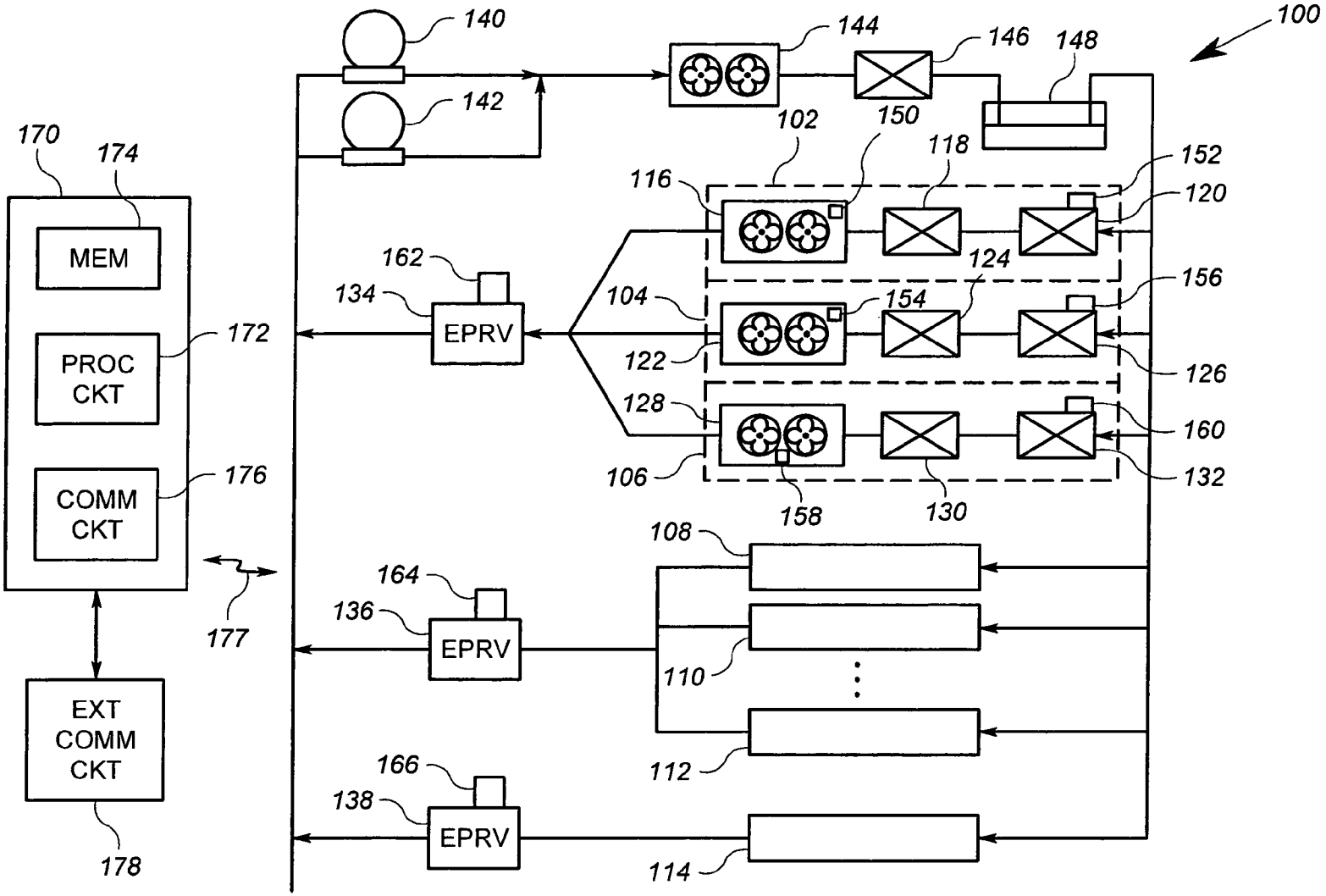
FIG. 1 shows a schematic diagram of an exemplary cooling system that incorporates an embodiment of the invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

A vapor compression refrigeration system 100 that incorporates an embodiment of the invention is depicted in FIG. 1. It will be appreciated that the system 100 shows merely a simplified example of a refrigeration system and that the inventive concepts of the control arrangement may be implemented in a variety of ways in any suitable refrigeration system.

In the example of FIG. 1, the vapor-compression refrigerator system 100 includes multiple refrigeration case subsystems including case subsystems 102, 104, 106, 108, 110, 112 and 114. The vapor-compression refrigeration system 100 further includes three evaporator pressure regulator valves 134, 136, 138, two compressors 140, 142, a condenser 144, and head pressure regulating valve 146, and a receiver 148.

The case subsystem 102 includes an evaporator 116, a thermostatic expansion valve (TEV) 118, and a liquid line solenoid valve (LLV) 120. The evaporator 116 is a device well known in the art that is operable to perform a heat exchange between refrigerant within the evaporator 116 and the surrounding air with a refrigeration case, not shown. Further detail regarding the evaporator 116 is provided below in connection with FIG. 2. The TEV 118 is a device that is operable to receive high pressure refrigerant at an input and provide low pressure, low temperature refrigerant at an output. Such devices are generally known, but may take different forms. The LLV 120 is a controllable valve that may be used to controllably meter refrigerant into the evaporator 116. By "controllable valve", it is meant that the LLV 120 includes an actuator that may be controlled via electrical signals, as is known in the art. The actuator determines how open or closed the valve is responsive to electrical control signals, as is also known in the art. Most of the valves described herein, and all that are controlled by controllers, include some version of actuator having these capabilities.

More specifically, the LLV 120 has an input operably coupled to receive high pressure refrigerant from the receiver 148. The LLV 120 further has an output operably connected to provide the refrigerant to the TEV 118. The TEV 118 is further coupled to provide low temperature, low pressure refrigerant to an input of the evaporator 116. The evaporator 116 has an output connected to the EPRV 134.

Similar to the case subsystem 102, the case subsystem 104 includes an evaporator 122, a TEV 124, and a LLV 126, which may suitably be have the same structure and/or function as the corresponding evaporator 116, TEV 118 and LLV 120 of the case subsystem 102. In the case subsystem 104, however, the evaporator 122 is located in a different refrigerator case than that which contains the first evaporator 116. As with the first case subsystem 102, the LLV 126 has an input operably coupled to receive high pressure refrigerant from the receiver 148. The LLV 126 also has an output operably connected to provide the refrigerant to the TEV 124. The TEV 124 is further coupled to provide low temperature, low pressure refrigerant to an input of the evaporator 122. The evaporator 122 has an output connected to the EPRV 134.

Likewise, the case subsystem 106 includes an evaporator 128, a TEV 130, and a LLV 132, which may suitably be have the same structure and/or function as the corresponding evaporator 116, TEV 118 and LLV 120 of the case subsystem 102. The evaporator 128 is located in a different refrigerator case than either of those that contain the evaporators 116 or 122. As with the other subsystems 102 and 104, the LLV 132 has an input operably coupled to receive high pressure refrigerant from the receiver 148. The LLV 132 further has an output operably connected to provide the refrigerant to the TEV 130. The TEV 130 is further coupled to provide low temperature, low pressure refrigerant to an input of the evaporator 128. The evaporator 128 has an output connected to the EPRV 134.

Thus, the refrigerant case subsystems 102, 104 and 106 connect to a common receiver 148 and to a common EPRV 134. The refrigerant case subsystems 108, 110 and 112 may suitably have the same structure as the case subsystem 102, described in detail above. The case subsystems 108, 110 and 112 are each disposed in corresponding refrigerator cases, and also include a connection to the common receiver 148 of the refrigeration system 100. However, the case subsystems 108, 110 and 112 are all commonly connected to a different EPRV 136.

In this exemplary system 100, another case subsystem 114 is coupled between the common receiver 148 and yet another EPRV 138. However, it will be appreciated that the number of evaporators and/or refrigeration case subsystems will vary from system to system. The principles of this embodiment of the invention may readily be adapted to such other systems by one of ordinary skill in the art.

The EPRV 134 is a controlled valve that regulates the pressure in the evaporators 116, 122 and 128. In general, control of the EPRV 134 helps control the temperature of the refrigerant within the evaporators 116, 122 and 128. Further detail regarding the control of the EPRV 134 is provided below in connection with FIG. 2. In a similar manner, the EPRV 136 is a controlled valve that regulates the pressure in the evaporators of the refrigeration cases 108, 110 and 112, and the EPRV 138 is a controlled valve that regulates pressure in the evaporator of the refrigeration case 114.

The EPRVs 134, 136 and 138 are commonly connected to provide refrigerant to two parallel-connected compressors 140 and 142. Each of the compressors 140, 142 is a refrigerant compression device having mechanical structure and operation well-known in the art. The compressors 140, 142 are configured to increase the pressure and temperature of the refrigerant received from the EPRVs 134, 136 and 138. The compressors 140, 142 are configured to provide the high pressure refrigerant to the condenser 144.

The condenser 144 is a device that is configured to create a heat exchange between surrounding air and high pressure, high temperature refrigerant within the condenser 144. The condenser 144 may suitably located external to the building, or at least in direct communication with external air.

The condenser 144 is operably connected to provide refrigerant to the head pressure regulating valve 146. The head pressure regulating valve 146 helps maintain the pressure of the refrigeration system 100, and has an operation and structure well known in the art. The head pressure regulating valve 146 is operably coupled to provide the refrigerant to the receiver 148. As discussed above, the receiver 148 is operably coupled to the inputs of the refrigerant cases 102, 104, 106, 108, 110, 112 and 114.

In accordance with an embodiment of the invention, the refrigeration system 100 employs a distributed control arrangement for maintaining desired temperatures within the refrigeration cases cooled by the various case subsystems. The arrangement includes a first microsystem 150 including a first MEMs sensor configured to measure at least a first operational parameter of a first of the plurality of refrigeration devices. In the exemplary embodiment of FIG. 1, the first microsystem 150 has a MEMs sensor configured to measure an air temperature proximate to the evaporator 116.

The control arrangement also includes a first controller 152 operable to generate a first actuator control signal based, at least in part, directly or indirectly on the first operational parameter measurement. In the exemplary embodiment described herein, the first controller 152 generates a control signal that controls the LLV 120 based on the air temperature measurement that is taken proximate to the evaporator 116 by the microsystem 150. In general, if the controller 152 determines that the air temperature is below a predetermined threshold, then the controller causes the LLV 120 (via its actuator) to be closed to restrict the flow of refrigerant into the evaporator 116. As a result, if the air in the refrigerated case is cool enough, then the flow of refrigerant is restricted to reduce energy consumption in the system 100.

The distributed control arrangement also includes a second microsystem 154 including a MEMs sensor configured to measure an operational parameter of a second of the plurality of refrigeration devices. In the exemplary embodiment of FIG. 1, the second microsystem 154 has a MEMs sensor configured to measure an air temperature proximate to the evaporator 122. The control arrangement also includes a second controller 156 that is operable to generate a second actuator control signal based, at least in part, directly or indirectly on the operational parameter measurement generated by the microsystem 154.

In the exemplary embodiment described herein, the second controller 156 generates a control signal that controls the LLV 126. The second controller generates the control signal based on an air temperature measurement provided by the microsystem 154, which is located proximate to the evaporator 122. The second controller 156 may suitably operate in a manner that is analogous to that of the first controller 152.

In the exemplary embodiment described herein, the distributed control arrangement includes a similar third microsystem 158 having a MEMs sensor configured to measure an air temperature proximate to the evaporator 128. The control arrangement also includes a third controller 160 configured to control the LLV 132 based on the air temperature measurement received from the third microsystem 158.

Thus, each refrigerator case subsystem 102, 104 and 106 includes a local control loop that assists in maintaining air temperature within the respective refrigerator case, not shown. It will be appreciated that the refrigerator case subsystems 108, 110, 112 and 114 will have similar local control loops. It will further be appreciated that the controllers 152, 156 and 160 may generate control signals based on other factors, such as set points, or other sensor values. Set points may be programmed directly into the local controllers 152, 156 or 160, or transmitted from a supervisory control station 162. Additional detail regarding the supervisory control station 162 is provided further below.

In addition to individual case control, one embodiment of the invention includes distributed control of the EPRVs 134, 136 and 138 based at least in part on MEMs-based temperature measurements. For example, the EPRV 134 includes a controller 162 that may suitably control the operation of the EPRV 134 based at least in part on the temperature measurements from the microsystems 150, 154 and 158. If the median, average or maximum temperature measurement from the microsystems 150, 154 and 158 exceeds a threshold, then the controller 162 causes the EPRV 134 to be adjusted to decrease the pressure in the evaporators 116, 122 and 128. Control schemes for regulating evaporator pressure based on a desired and measured temperature of air in the evaporator is known in the art. The EPRVs 136 and 138 have similar controllers 164 and 166, respectively.

The supervisory control station 170 includes a processing circuit 172, a memory 174 and a communication circuit 176. In this embodiment, the arrangement further includes an external communication device 178. The external communication device 178 is a device that is operably connected to enable communications between the control station 170 and a remote device. For example, the external communication device 178 may include an internet modem and electronic mail server. The supervisory control station 170 may take the form of a computer workstation, a programmable building automation system field controller, or a combination of both, which are hardware and software configured to perform the operations described herebelow.

In the exemplary embodiment described herein, the communication circuit 176 is configured to communicate and exchange information with the microsystems 150, 154, 158 and controllers 152, 156, 160, 162, 164 and 168 via a communication link 177. To this end, the sensor microsystems and controller include wireless communication circuits, and use wireless communications as at least part of the communication link 177. Further details regarding an exemplary embodiment of the microsystems 150, 154 and 158 are provided below in connection with FIGS. 3 and 4. In general, however, the wireless microsystems 150, 154 and 158 and controller modules 152, 156, 160, 162, 164 and 166, as well as other wireless sensor modules and other controller modules, not shown, cooperate to form a wireless mesh network that allows communication among any of the nodes, i.e. the wireless sensor modules, the controller modules and the communication circuit 176 of the supervisory control station 170.

Figure 5:
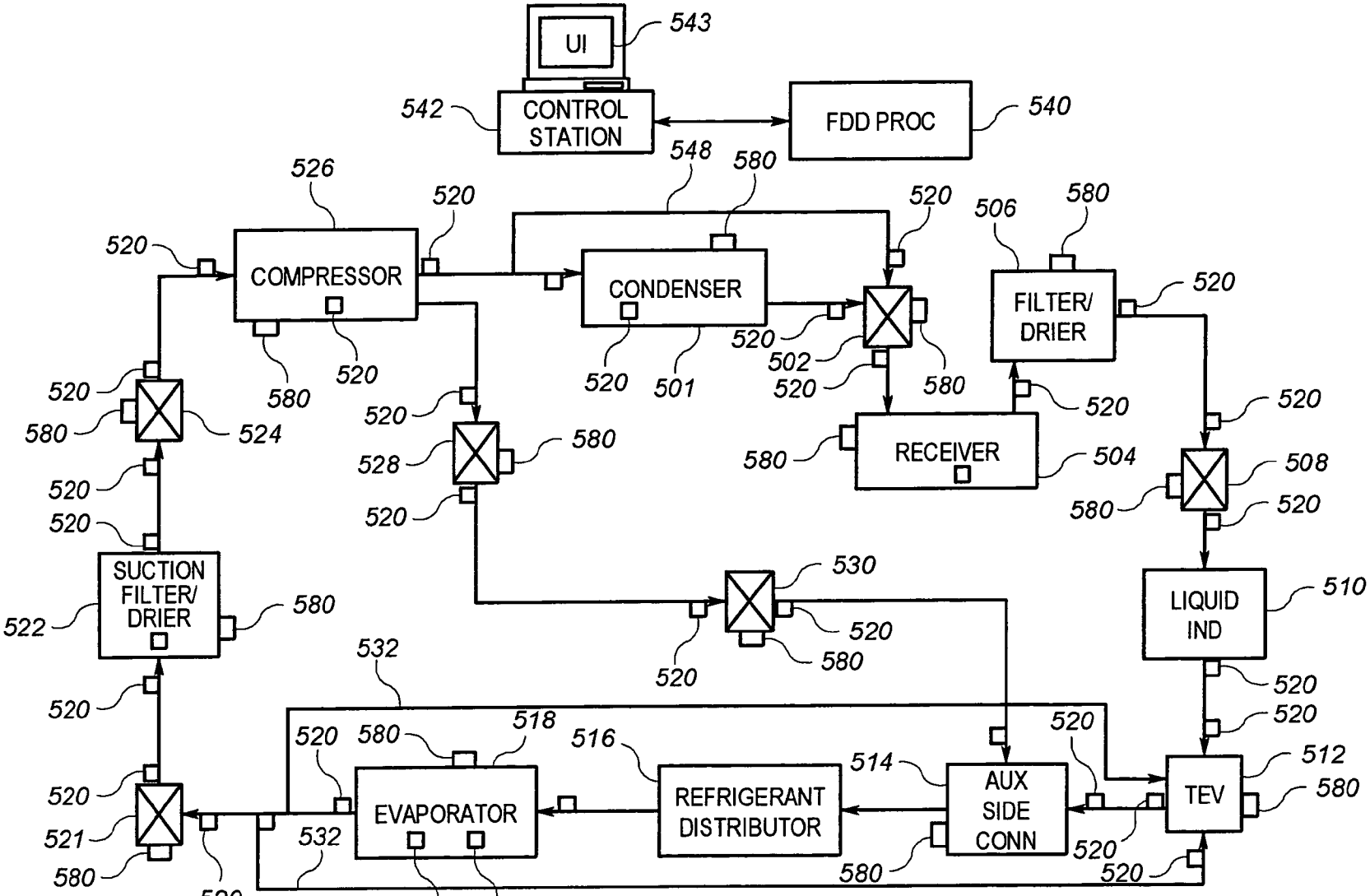
FIG. 5 shows a schematic diagram of another exemplary cooling system that incorporates another embodiment of the invention.

The processing circuit 172 is configured to receive and store controller values, measured values, and other information via the communication circuit 176 for supervisory and/or monitoring purposes. By way of example, the sensor values may be analyzed by the processing circuit 172 to determine if a fault is present in system 100. To this end, the system 100 may suitably include many more wireless Microsystems measuring a wide variety of quantities, such as illustrated in the embodiment of FIG. 5, discussed further below.

In any event, the processing circuit 172 also enables remote monitoring and control of the distributed control arrangement via the external communication device 178. In particular, the external communication device 178 allows for stored sensor and control information to be accessed remotely by another computer or data device. To this end, the external communication device may suitably employ known remote data accessing techniques such as those discussed in U.S. patent application Ser. No. 10/463,818, filed Jun. 17, 2003, which is incorporated herein by reference. This configuration allows controller set points for the controllers 152, 156, 160, 162, 164 and/or 166 to be generated or changed remotely via the external communication device 178, processing circuit 172 and communication circuit 176.

Thus, the above described embodiment illustrates, among other things, implementation of distributed control in a refrigeration system using MEMs-based sensors and short-range RF communications. The distributed control using RF communications greatly reduces wiring requirements that would otherwise make such a system infeasible.

Figure 2:
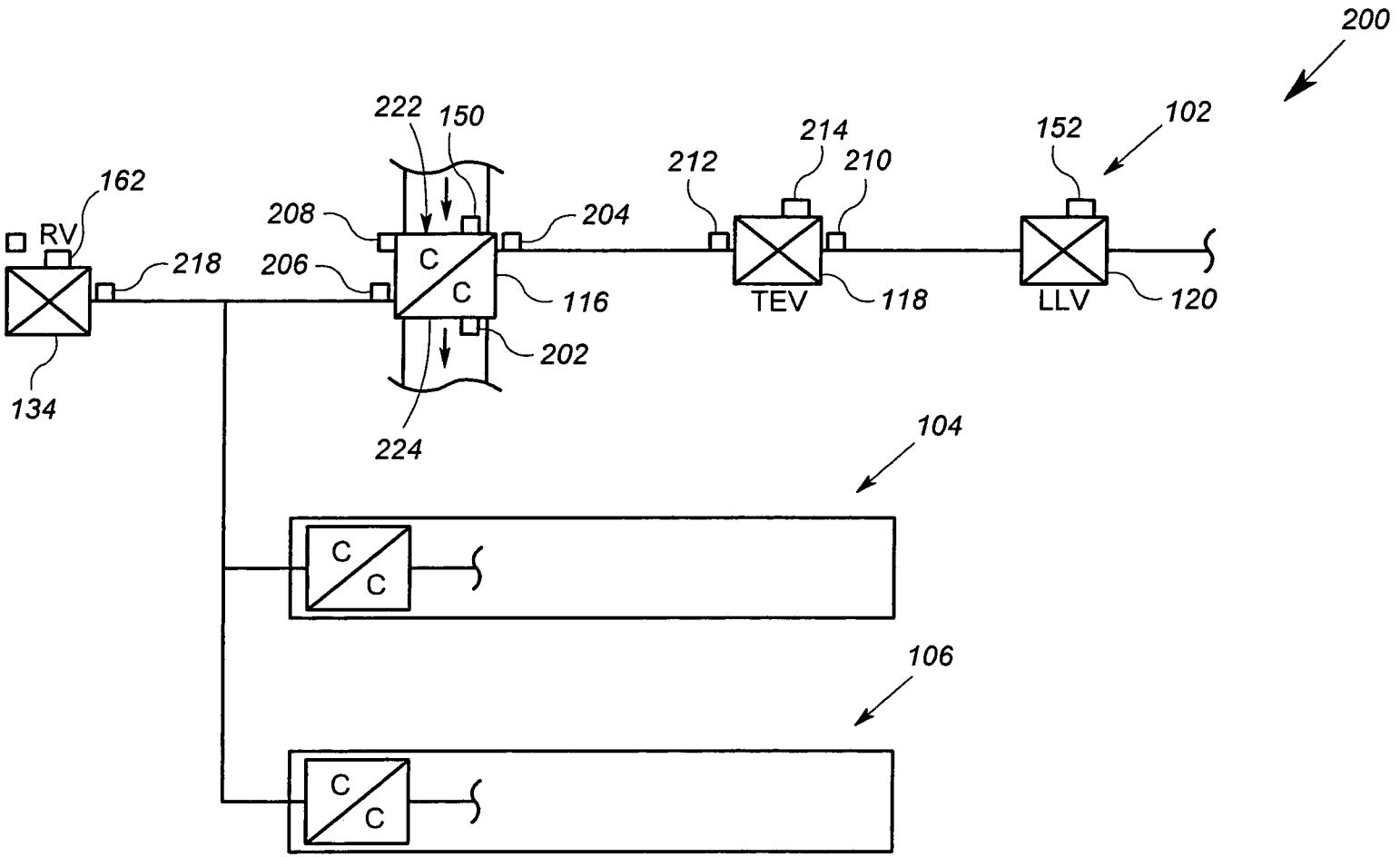
FIG. 2 shows in further detail a portion of the exemplary cooling system of FIG. 1.

FIG. 2 shows in further detail a further exemplary embodiment of a control arrangement 200 for a portion of the system 100 of FIG. 1 that includes the EPRV 134 and refrigerator case subsystems 102, 104 and 106. Like reference numbers denote like elements.

Referring to the refrigerator case subsystem 102, the detailed drawing of FIG. 2 shows the evaporator 116, the TEV 118, LLV 120 and EPRV 134 of FIG. 1, as well as the microsystem 150, LLV controller 152 and EPRV controller 162. In addition, as shown in FIG. 2, the arrangement 200 further includes another microsystem 202 coupled to the discharge air outlet 224 of the evaporator 116, refrigerant microsystem sensors 204 and 206 coupled to the refrigerant input and output, respectively, of the evaporator 116, a fan controller 208 operably coupled to the fan motors, not shown, of the evaporator 116, refrigerant microsystems 210 and 212 coupled to the refrigerant input and output, respectively, of the TEV 118, and a refrigerant microsystem 218 coupled to the refrigerant input of the EPRV 134.

The evaporator 116 includes refrigerant tubing and at least one fan, not shown, but which would be known to those of ordinary skill in the art. Air from the refrigerator case, not shown, enters the evaporator 116 at the return air inlet 222, passes next to the refrigerant coils in a heat exchanging manner, and exits though the discharge air outlet 224. The refrigerant tubing connects the refrigerant input to the evaporator 116 to the refrigerant output of the evaporator 116, as is known in the art.

Figure 3:
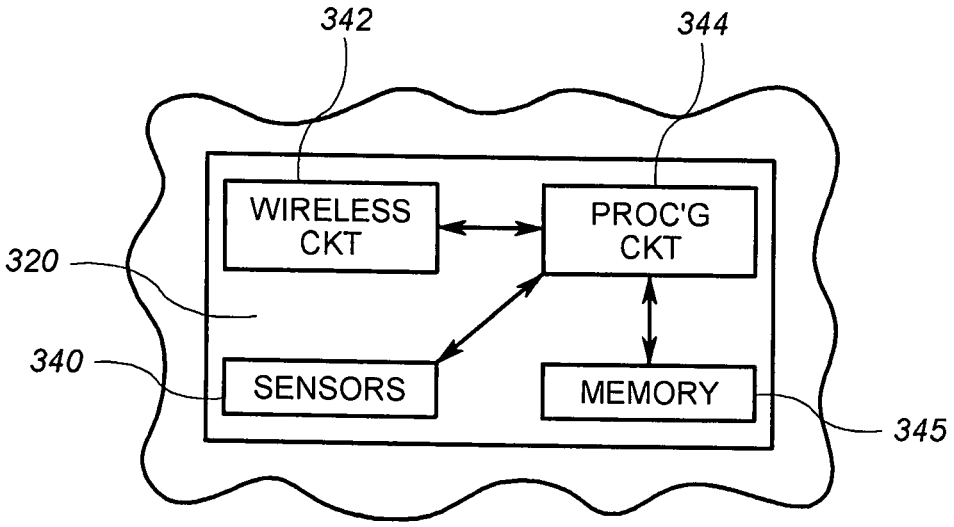
FIGS. 3 and 4 show an exemplary microsystem that may be used in the embodiment of FIGS. 1, 2 and 5.
Figure 4:
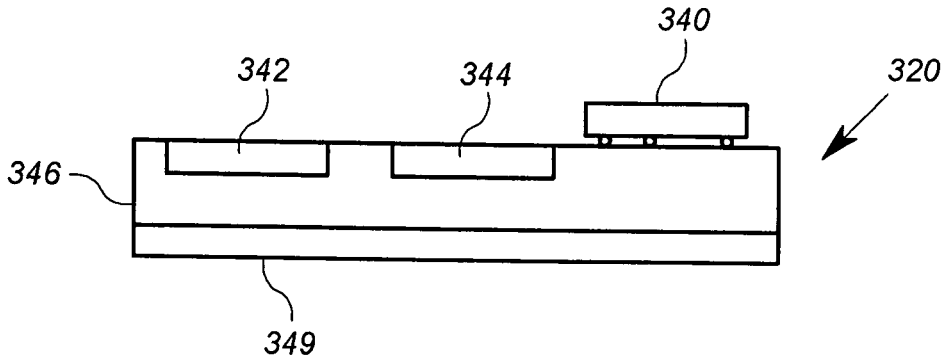

The microsystem 150 is configured to measure the temperature of air entering the evaporator 116 at the return air inlet 222. To this end, as discussed above in connection with FIG. 1, the microsystem 150 is a device that includes a MEMs-based air temperature sensor, wireless communication capability, and processing circuitry. FIGS. 3 and 4 show an exemplary embodiment of a microsystem 320 that may be the microsystem 150. The microsystem 202 also includes a MEMs-based air temperature sensor, and may suitably have the same construction as the microsystem 150. The microsystem 202 is configured to measure the air temperature at the discharge air outlet 224.

The refrigerant sensor 204 is a device that includes MEMs-based temperature and pressure sensors, wireless communication capability and processing circuitry. The refrigerant sensor 204 may suitably have the same construction as the microsystem shown in FIGS. 3 and 4, except that the sensor technology would include temperature and pressure sensors suitable for refrigerant in liquid and/or gaseous state. The current state of the art of MEMs microsystems enables such sensor technology. The refrigerant sensor 206 may suitably have the same construction.

The refrigerant sensors 210 and 212 of the TEV 118 and the refrigerant sensor 218 may be similar or identical in structure to the refrigerant sensors 204 and/or 206.

The controller 152 is a device that includes wireless communication circuitry and processing circuitry, which may be a microsystem, or at least include a microsystem. The controller 152 is operable to generate an actuator control signal for the LLV 152 based on a set point and temperature measurement information from the return air inlet microsystem 150. The temperature measurement information from the return air inlet microsystem 150, or simply return air temperature, identifies with some accuracy the ambient temperature in the refrigerator case in which the evaporator 116 is located. If the return air temperature is above a desired set point, then the controller 152 generates a control signal that causes the actuator of the LLV 152 to open the valve to allow refrigerant to pass into the evaporator 116. If the return air temperature is below a desired set point, then the controller 152 generates a control signal that causes the actuator of the LLV 152 to close the valve to restrict the flow of refrigerant into the evaporator 116. The controller 152 generates the above described control signals subject to delays and/or filtering ordinarily used for process control. The controller 152 may, for example, use PID control to generate the "open" and "close" control signals responsive to the return air temperature.

The controller 152 is further operable to communicate alarm information to the controller 162 of the EPRV 134 if the return air temperature cannot attain the set point temperature after the LLV 152 has been open for a predetermined duration.

The controller 214 is a device that may suitably have the same structure as the controller 152. The controller 214 is operably coupled, however, to control the position of the TEV 118. To this end, the controller 214 is configured to obtain pressure and temperature measurement information from the sensors 210 and 212 via wireless communications. The controller 214 is configured to generate control signals that cause the TEV 118 to further open or close based on the temperature and pressure information (from sensors 210 and 212) and a set point. Control algorithms for controlling a TEV 118 based on the change in pressure and temperature would be known to those of ordinary skill in the art.

The controller 208 is operably connected to controllably activate or deactivate the fan of the evaporator 116. The controller 208 may suitably perform this operation based on a command received from another controller, such as the supervisory control station 170. (See FIG. 1). However, the controller 208 may also cause the fan to be activated or deactivated based on air temperature measurements from the Microsystems 150 and 202.

The controller 162 is a device that may suitably have the same structure as the controller 152. The controller 162 is configured to generate control signals that regulate the position of the EPRV 134. As is known in the art, the EPRV 134 can be used to adjust the pressure/temperature of the refrigerant in the evaporator 116 (as well as the evaporators 122 and 128). To this end, the controller 162 receives temperature measurement information from the microsystem 202 located at the discharge air outlet 224. Such information is referred to herein as the discharge air temperature. The discharge air temperature provides a measure of the chilled air provided by the evaporator 116 to the refrigerator case. The controller 162 receives similar discharge air temperature measurements from similarly located Microsystems, not shown, in the refrigerator case subsystems 104 and 106.

In general, the controller 162 is configured to generate control signals that cause the EPRV 134 to further open or close in order to adjust the discharge air temperature toward a set point. The controller 162 may suitably receive the set point from the supervisory control station 170, or via programming from another source such as a portable programming device. As mentioned above, the controller 162 receives discharge air temperatures from each of the refrigerator case subsystems 102, 104 and 106. The controller 162 may suitably use a median of the three discharge air temperatures as the process value in the control operations.

The controller 162 may also be configured to change the set point for the discharge air temperature responsive to receiving a temperature alarm message from the controller 152 (or controllers 156 or 160 of FIG. 1). The temperature alarm message indicates that the return air temperature within the corresponding refrigerator case has not reached the return air set point after leaving the LLV 120 completely open for a predetermined period of time. Responsive to such an alarm message, the controller 162 may at least temporarily lower the discharge air set point used in the control of the EPRV 134.

The above-described control operations are enabled by the use of wireless Microsystems for extensive sensing and communication. As with the embodiment of FIG. 1, the sensors 150, 202, 204, 206, 210, 212, 218, as well the controllers 152, 208, 214 and 162 form a wireless mesh network that allows any two nodes in the system to communicate, including communication between any two Microsystems, or between any microsystem to transmit and the supervisory control station 170. The wireless mesh network thus allows extensive sensing, distributed control, and data collection, without requiring each microsystem to have high power signal transmission capabilities.

FIGS. 3 and 4 show an exemplary microsystem 320 in the form of a sensor module that may be configured to be used as any of the Microsystems 150, 202, 204, 206, 210, 212, 218. It will be appreciated that the microsystem 320 would be configured differently to measure different values, as will be discussed below. The microsystem 320 is designed such that it can be affixed to a plurality of devices exposed to a variety of measurable conditions. For example, the microsystem 320 may configured be affixed to the inside of piping to measure refrigerant qualities, or affixed to a wall of the return air inlet 222 or discharge air outlet 224.

In order to detect or obtain the measurement information (i.e. pressure, temperature, etc.), the microsystem 320 includes a sensor device 340 that is configured to measure the specified quantity. The microsystem 320 further includes a wireless communication circuit 342 operable to communicate the measurement information (or information derived therefrom) to a remotely located wireless communication circuit, such as the controller 152 of FIG. 1. In the embodiment described herein, the wireless communication circuit 342 is operable to communicate using a wireless mesh network formed by other microsystems. Thus, the communication circuit 342 of the microsystem 320 may transmit information to relatively distant devices, for example, a supervisory control station similar to the station 170 of FIG. 1, while still having limited transmission range.

In the embodiment described herein, the sensor device 340 is preferably one or more microelectromechanical system sensors or MEMS sensors. MEMS sensors have the advantage of requiring relatively little space and electrical power, and have relatively little mass. In one example, such as for the sensors 204, 206, 210, 212 and 218 of FIG. 2, the sensor device 340 is a set of MEMS sensors that include a pressure sensor and a temperature sensor. A combination of a MEMS pressure sensor and a MEMS temperature sensor can readily fit onto a small enough footprint to allow the microsystem 320 to fit onto refrigerant piping. In another example, such as for the sensors 150 and 202, the sensor device 340 is a MEMS air temperature sensor. In still other examples, the sensor device may be a Hall-effect sensor or another type of MEMs sensor.

The processing circuit 344 is operable to generate digital information representative of the sensed quantities and prepare the information in the proper protocol for transmission.

It is preferable that the communication circuit 342 and the processing circuit 344 be incorporated onto the same substrate as the sensor device 340. FIG. 4 shows a side view of the microsystem 320 wherein the various components are incorporated into one chip. To allow for incorporation of the communication circuit 342 on a single chip, on-chip Bluetooth communication circuits are known. In addition, methods of attaching MEMS devices to semiconductor substrates is known, such as is taught in connection with FIG. 8 of U.S. patent application Ser. No. 10/951,450 filed Sep. 27, 2004 and which is incorporated herein by reference.

An advantageous embodiment of the microsystem 320 is a semiconductor substrate 346 having the processing circuit 344 and the communication circuit 342 formed thereon, and a MEMS sensor device 340 attached thereto, such as by flip-chip bonding. In addition, it would be advantageous to attach a power source such as a battery to the substrate 346. The battery may suitably be a lithium ion coin cell type structure 349 affixed to the side of the semiconductor substrate 346 opposite the processing circuit 344 and communication circuit 342. It will be appreciated that if a suitable communication circuit cannot be formed in the semiconductor substrate 346, then the communication circuit may also be separately formed and then attached via flip-chip or similar type of bonding.

The microsystem module 320 may also be configured as a controller suitable for use as the controller 152 or controller 162 of FIG. 2. If the module 320 is used as a controller, then module 320 may, but need not, have a sensor device 340. It will be appreciated that the processing circuit 344 would have a digital output to an actuator, or if the actuator is controlled by an analog voltage, a D/A conversion circuit. The microsystem module 320 used as a controller may also avoid the need for a battery by tapping power off of the power that is provided to the corresponding actuator.

In some embodiments, a microsystem that is configured as a sensor microsystem, such as the microsystem 320 of FIG. 3, may also generate the control output for an actuator that is remote from the microsystem. The microsystem 320 would then transmit the control output wirelessly to a wireless receiver connected to an actuator. To this end, the processing circuit of the microsystem 344 would generate a control output using the sensed values from the sensor device 340 (and/or sensor values received wireless from other Microsystems) and a set point received wirelessly from another remote device, such as the control station 170 of FIG. 1. Thus, for example, the microsystem sensor 150 of FIG. 1 may suitably generate the sensor values for the return air temperature as well as the control value for the LLV 120. In such as case, the controller 152 is not necessary, and may be replaced by a wireless device that is operable to cause actuation of the LLV 120 based on control signals generated within and transmitted by the microsystem 150.

Referring now to FIG. 5, a different example of an exemplary refrigeration system 100 that incorporates distributed control and combines distributed control with fault detection is shown. The example of FIG. 5 only shows a single evaporator 518, but illustrates in further detail other devices commonly used in a refrigeration system. While the example of FIG. 1 focused on the use of distributed control in evaporator subsystems, the example of FIG. 5 illustrates how distributed control (and distributed fault detection) may be employed throughout other elements of a refrigeration system.

The example system 500 of FIG. 5 does not represent any particular preferred form of refrigeration system for use with the arrangement of the invention, and instead is only provided to demonstrate how the concepts of the arrangement of FIG. 1 may be expanded to other devices and elements of an ordinary refrigeration system.

As with the example of FIG. 1, a vapor-compression refrigerator system 500 of FIG. 5 includes the four main components: a compressor 526, a condenser 501, a TEV 512, and an evaporator 518 connected as shown in FIG. 5. In further detail, the compressor 526 is operably coupled to provide compressed refrigerant to a condenser 501 and separately to a hot gas solenoid valve 528. The condenser 501 is coupled to provide refrigerant to a head pressure control valve 502. The head pressure control valve 502 also includes an input connected to a bypass line 548 that is coupled to an input of the condenser 501. The head pressure control valve 502 is operably coupled to provide refrigerant to a receiver 504, which in turn is operably coupled to provide refrigerant to a filter-drier 506. The operations and functions of such devices are well known to those of ordinary skill in the art.

The filter-drier 506 is operably coupled to the thermostatic expansion valve (TEV) 512 through a liquid line solenoid valve 508 and a moisture and liquid indicator 510. The TEV 512 has an output coupled to the evaporator 518 via a distributor 516 as is known in the art. An auxiliary side connector 514 provides a coupling for receiving refrigerant from a discharge bypass valve 530. The discharge bypass valve 530 is coupled to receive refrigerant from the hot gas solenoid valve 528, discussed above.

The evaporator 518, which is suitably located in communication with a compartment to be chilled, not shown, has a refrigerant output connected to an evaporator pressure regulating valve 521. The evaporator pressure regulating valve 521 is operably coupled to provide refrigerant to the suction filter 522. The suction filter 522 is coupled to provide refrigerant to the crankcase pressure regulating valve 524, which in turn is connected to the compressor 526. Such devices and their operation is known in the art.

The system 500 of FIG. 5 also includes a distributed control scheme, wherein many individual components have closed loop control arrangements. The distributed control arrangement of FIG. 5 includes a supervisory control processor 540, a control station 542 having a user interface, a plurality of MEMs wireless sensor modules 520 and a plurality of controller modules 580. Individual control arrangements include, for each device, one or more of the sensor modules 520 and at least one controller module 580.

The system 500 further includes an arrangement for fault detection and diagnosis of the system 500. The arrangement for fault detection and diagnosis includes the sensor modules 520, the supervisory control processor 540, the control station, and to the extent necessary to form the wireless mesh network, the controller modules 580.

To provide fault detection as well as control, the sensor modules 520 are placed throughout the system 500. Sensor modules 520 may be configured to obtain measurements of refrigerant parameters and/or measurements of electrical, hydraulic or mechanical parameters of individual devices in the system 500. To this end, the sensor modules 520 include one or more of variety of MEMS sensors to sense different operating characteristics of the system 500. The wireless sensor modules 520 may suitably have the functionality and structure of the microsystem 320 of FIGS. 1, 3 and 4, or variants thereof. The sensor modules 520 also include short range wireless communication capability, similar to the microsystem 320 of FIGS. 1, 3 and 4.

Each controller module 580 may suitably be a microsystem-based controller element, not shown, but which may have a similar structure as the microsystem 320, discussed above. The controller module 580 does not, however, necessarily include a sensor. The controller module 580 has processing circuitry, not shown, operable to perform PI, PID or other types of control algorithm to control one or more actuators in a device under control. The controller module 580 performs such control based on a set point and sensed values received wirelessly from one or more of the wireless sensor modules 520.

By way of example, the liquid line solenoid valve 508 has a controller module 580 that may suitably control the operation of a solenoid to open or close a valve mechanism, based on temperature measurements of the evaporator discharge air received from sensor modules 520 located near the evaporator 518. Various control schemes may be carried on various actuating devices, such as the valves 502, 508, 512, 520, 524, 528 using their controllers 580 and corresponding sensors 520. By way of example, control the head pressure control valve 502 would be a function of pressure measured in the condenser 501. In another example, control of the evaporator pressure regulating valve 521 would be depend on the discharge air temperature in the evaporator 518.

It will be appreciated that the distributed control aspect that is facilitated by the controller modules 580 need not be implemented in order to obtain many of the advantages of the fault detection arrangement of the embodiment of FIG. 5. However, it is noted that the use of Microsystems to measure operational parameters of the system 500 for fault detection and diagnosis, as described herein, further facilitates distributed control because of the ready availability of data needed for distributed control.

The wireless sensor modules 520 and controller modules 580 cooperate to form a wireless mesh network that allows communication among any of the nodes, i.e. the sensor modules 520, controller modules 580, the supervisory control processor 540 and the control station 542, of the system 500. As discussed above in connection with the embodiment of FIG. 1, the wireless mesh network allows for transmission between any two nodes using a series of short transmission hops between closely located nodes. Accordingly, if a sensor module 520 needs to communicate with the supervisory control processor 540, the sensor module 520 may communicate either directly with the supervisory control processor 540 (if closely located) or through a series of intermediate sensor modules 520 and/or controller modules 580.

In general, the sensor modules 520 obtain measurements of parameters of the refrigerant, such as temperature and pressure, and provides the information to the supervisory control processor 540. If the measurements obtained by a sensor module 520 are also useful for control of a device within the system 500, then the sensor module 520 also provides the information to the corresponding controller module 580.

In any event, in the fault detection and diagnosis operation, the supervisory control processor 540 compares the values, or combinations of the values, to one or more reference values.

The reference values may suitably represent the limits of the acceptable value range for the measured value or combination of measured values being compared. The supervisory control processor 540 selectively generates an alarm or fault message based on the outcome of the comparison. In particular, if the result of the comparison corresponds to the value or combination of values being within an accepted range, then an alarm message is not generated. If, however, the result of the comparison corresponds to the value or combination of values being outside an accepted range, then the alarm message is generated. If the alarm message is generated, the supervisory control processor 540 stores the message. Other measured values may be stored or linked to the alarm event so that when the alarm is analyzed, other conditions in the system that existed at the time of the alarm may be observed and considered.

To this end, the supervisory control processor 540 may suitably carry out operations analogous to those of the processing circuit of the controller 152 of FIG. 1.

Thus, in an exemplary operation, the supervisory control processor 540 tests from time to time the differential in pressure between the input and output of the TEV 512. Thus, the sensor modules 520 at the input and output of the TEV 512 obtain pressure measurements (Pin, Pout) and communicate the measurements to the supervisory control processor 540. The supervisory control processor 540 compares the difference in pressure, or Pin−Pout to at least one threshold to determine if the difference in pressure is excessive. If so, then the supervisory control processor 540 generates an alarm message or alarm record. The supervisory control processor 540 stores the alarm message as well as other sensor values measured in the system 500 at about the same time.

In the example of FIG. 5, it will be appreciated that each sensor module 520 is located in a sensing relation with the process variable that it is intended to sense. For example, pressure and temperature sensors in a sensor module 520 may be in contact with the refrigerant at various locations. Other sensor modules 520 may include electrical sensors (e.g. MEMs or non-MEMs Hall-effect sensors) to measure current and/or voltage that are disposed near an electrical power input conductors.

Thus, the supervisory control processor 540 combined with the sensor data from the sensor modules 520 can help improve the fault detection in the system 500. The additional information allows for improved fault detection due to the large amount of system information.

The supervisory control controller 540 may suitably be constructed based on a commercially available building automation system design, such as an MEC, TEC, Talon or Saphir controller available from Siemens Building Technologies, Inc. of Buffalo Grove, Ill. Such controllers may be adapted to carry out the operations described herein. The supervisory control processor 540 in one embodiment employs a BACnet-based protocol for exchanging information with the work station 542 and in many cases the controllers 580 and sensor modules 520. Both standard and proprietary objects can be employed.

For the purposes of the distributed control scheme of the embodiment of FIG. 5, the supervisory control processor 540 is further configured to receive select information from the controllers 580 and sensor modules 520 for the purpose of monitoring system performance to accurately predict and communicate system faults and inefficiencies. For example, instead of merely monitoring process variables, the supervisory control processor 540 may suitably monitor the output control variables of the supervisory control processor 540 to detect poor response or operation of device.

The supervisory control processor 540 may include a display, as is typical of higher end commercially available field controllers. In such a case, the supervisory control processor 540 may be configured to display select data relative to all smart system components, such examples include, but are not limited to: learned set points, component in-service and cumulative run time, valve positions, system case and discharge air temperatures, I/O status, select system high & low side pressures, oil levels, presence of refrigerant gas, and other select information.

The supervisory control processor 540 reports communication loss messages for all nodes on the network, and is responsible for logging pertinent system information into non-volatile memory, not shown. This information is accessible over the system network to allow it to be quarried, emailed, output to an spreadsheet file, printed, or displayed locally and remotely upon demand. These operations may alternatively be performed by the work station 542

The supervisory control processor 540 includes a non-volatile memory, not shown, that stores the baseline data, including energy consumption levels to create the system signature. It is this system signature, for example, the pressure-enthalpy curve, that form the basis for the reference values used in the comparison operations discussed further above.

In one embodiment, when the supervisory control processor 540 identifies a fault detection and diagnostic "FDD" event, an appropriate alarm shall be sent over the building automation network so that the problem can be pinpointed to maximize the efficiency of monitoring and maintenance personnel or other dispatched service.

The user interface (UI) control station 542 is a computer workstation or the like that allows a technician to locally or remotely configure the controllers 580 and sensors 520. The UI control station 542 preferably also allows the user to monitor the system by interrogating the supervisory control processor 540 or other individual component to observe the operation of the system 500.

In a preferred embodiment, the UI control station 542 includes a web browser based interface for displaying and organizing the requested system information. The web-browser based-interface allows for local or remote system configuration and data monitoring, including historical and real time graphing and display of data logs for individual smart system components or the overall system with user friendly, easy navigability, displaying as much information as possible in both text and graphical formats. A suitable control station is an INSIGHT™ model control station, available from Siemens Building Technologies, Inc. of Buffalo Grove, Ill., which has been modified to carry out the operations described herein.

In the discussions of FIGS. 1 and 5 above, it is noted that many of the sensor modules 320, 520 are configured to obtain temperature and pressure of the refrigerant at various locations in the refrigeration systems 100, 500 respectively. One exemplary method for implementing those sensor modules 520 is through a coupling device that incorporates a sensor.

Figure 6:
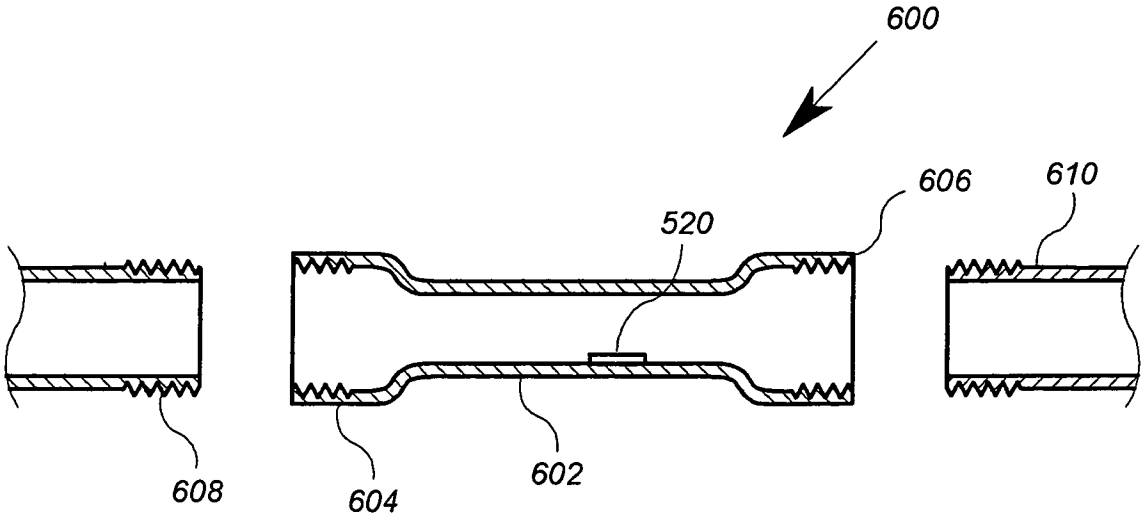
FIG. 6 shows an exemplary embodiment of a coupling device that may be used to obtain system data.

FIG. 6 shows a "smart" coupling unit 600 that may be used to obtain sensor data from refrigerant at various points in the system 500 of FIG. 5 (or even the system 100 of FIG. 1). The coupling unit 600 is a relatively short length of pipe that includes, in this embodiment, a central pipe portion 602, a first coupling end 604, a second coupling end 606 and a sensor module 520. The first coupling end 604 is configured to receive and couple to a pipe or fitting 608 of a system component, and the second coupling end 606 is configured to receive and couple to another pipe or fitting 610. The coupling ends 604, 606 may be threaded or non-threaded, and may take any form suitably used by refrigeration devices to couple pipes and/or fittings. In use, the coupling ends 604, 606 receive the pipe/fittings 608, 610, respectively, and may be brazed or soldered to secure the connection.

The wireless sensor module 520 is preferably securedly fixed in the interior of the central pipe portion 602 such that the sensors thereon are in a position to sense conditions of refrigerant passing through the pipe between the pipes 608 and 610. Then sensor module 520, as discussed above, preferably includes pressure and temperature sensors. An example of such a module is shown in FIGS. 3 and 4. In other embodiments, the sensor module 520 may additionally (or alternatively) contain MEMS sensors that detect contaminants, such as water vapor.

The smart coupling unit 600 inserted at any point in the system 100 in which there is refrigerant pipe, such as between any two elements of the system 500 shown in FIG. 5. The sensor module 520 is preferably secured to the pipe portion 602 such that the sensing portion 340 (See FIGS. 3 and 4) is in the flow stream of the refrigerant within the pipe portion 602. To facilitate low power RF communications from the sensor module 520 from inside of the pipe portion 602, the pipe portion 602, a first coupling end 604, a second coupling end 606 may be made transparent, such as of glass or the like. Alternatively, the coupling unit 600 may be outfitted with two wireless modules, the wireless module 520 on the inside that generates the measurements, and a wireless module (with or without sensors), not shown, secured to the outside of the pipe portion 602 that acts as an RF relay. The pipe portion 602 need not then be transparent or otherwise RF friendly because the transmission distance between the inside module 520 and the external module, not shown in FIG. 6, is very small.

One of the advantages of at least some embodiments of the invention arises from the fact that the microsystems (sensor modules 520) are relatively small, and perform wirelessly. This allows many sensor modules 520 to be used in a single system. Listed below are examples of what kinds of microsystem sensors may be appropriate and/or useful for fault diagnosis and detection in a refrigeration device.

Sensor Values for Expansion Valves

Expansion valves such as the TEV 110 of FIG. 1 and the TEV 512 of FIG. 5 are an integral part of most refrigeration systems. These expansion valves may be manual, automatic, mechanical, thermostatic, electric or electronic. Wireless and/or MEMs-based sensor modules could be used to measure the following TEV parameters, which would be beneficial for fault detection operations: Inlet refrigerant pressure and refrigerant temperature; Outlet refrigerant pressure and refrigerant temperature; Valve percent open position; Refrigerant mass flow rate; Driver motor voltage; Driver Motor amperage; Network communications proof; and wireless signal strength.

Another set of expansion devices used in refrigeration systems include capillary tubes, cap flo-raters, restrictors, and orifice-based refrigerant expansion devices. Wireless and/or MEMs-based sensor modules could be used to measure the following parameters for these devices, which would be beneficial for fault detection operations: Inlet refrigerant pressure and refrigerant temperature; Outlet refrigerant pressure and refrigerant temperature; Refrigerant mass flow rate; Network communications proof; and wireless signal strength.

Sensor Values for Evaporator Units

Evaporator units such as the evaporator 1115 of FIG. 1 and the evaporator 518 of FIG. 5 are another integral part most refrigeration systems. Wireless and/or MEMs-based sensor modules could be used to measure the following evaporator parameters, which would be beneficial for fault detection operations: Inlet refrigerant pressure and refrigerant temperature; Outlet refrigerant pressure and refrigerant temperature; Refrigerant mass flow rate; Network communications proof; and wireless signal strength.

Evaporator units also typically include a pressure regulator, such as the evaporator pressure regulating valve 521. Evaporator pressure regulators may be manual, automatic, mechanical, electric or electronic. Wireless and/or MEMs-based sensor modules could be used to measure the following device parameters, which would be beneficial for fault detection operations: Inlet refrigerant pressure and refrigerant temperature; Outlet refrigerant pressure and refrigerant temperature; Valve percent open position; Refrigerant mass flow rate; Driver motor voltage; Driver motor amperage; Network communications proof; and wireless signal strength.

Sensor Values for Condensor Equipment

Most refrigeration systems include a head pressure regulator, such as the head pressure control valve 502, at the output of the condenser 500. As with other devices, the head pressure regulator may be of several designs, including manual, automatic, mechanical, electric or electronic. Wireless and/or MEMs-based sensor modules could be used to measure the following parameters for these devices, which would be beneficial for fault detection operations: Inlet refrigerant pressure and refrigerant temperature; Outlet refrigerant pressure and refrigerant temperature; Valve percent open position; Refrigerant mass flow rate; Driver motor voltage; Driver motor amperage; Network communications proof; and wireless signal strength.

Sensor Values for Compressor Units

Evaporator units such as the evaporator 120 of FIG. 1 and the compressor 526 of FIG. 5 are yet another integral part most refrigeration systems. Wireless and/or MEMs-based microsystem sensors may be used to obtain the following types of measurements or information that would be beneficial for fault detection operations: Oil sump temperature; Inlet suction refrigerant pressure and refrigerant temperature; Outlet discharge refrigerant pressure and refrigerant temperature; Internal discharge refrigerant pressure and refrigerant temperature located inside each cylinder discharge cavity or top cap, or any scroll discharge cavity or top cap, or any rotary discharge cavity or top cap or any screw discharge cavity or top cap; Internal compressor motor electrical windings temperatures; Internal compressor motor electrical windings relative displacement; Compressor supply voltage measured between each voltage leg; Compressor supply amperage measured on each voltage leg; Compressor supply voltage frequency; Compressor inlet refrigerant mass flow rate; Compressor outlet refrigerant mass flow rate; Compressor body vibration; Compressor crankcase oil level; Compressor oil moisture indicator; Compressor oil acid pH indicator; Compressor oil pressure (if applicable); Compressor motor compartment pressure and temperature; Compressor unloader or capacity control device percent open position or duty cycle percent; Network communications proof; and Wireless signal strength A device that is typically associated with the compressor is a compressor pressure regulator, such as the crankcase pressure regulating valve 524. Wireless and/or MEMs-based microsystems may be used to measure the following quantities of the compressor/crankcase pressure regulator; Inlet refrigerant pressure and refrigerant temperature; Outlet refrigerant pressure and refrigerant temperature; Valve percent open position; Refrigerant mass flow rate; Driver motor voltage; Driver motor amperage; Network communications proof; and wireless signal strength.

Other Devices

There are several other devices common to refrigeration systems. One such device is a defrost pressure differential valve, which is not shown FIG. 5, but would be known to those of ordinary skill in the art. In defrost pressure differential valves, wireless and/or MEMs-based sensor modules similar to that of FIGS. 3 and 4 may be used to measure the following quantities: Inlet refrigerant pressure and refrigerant temperature; Outlet refrigerant pressure and refrigerant temperature; Valve percent open position; Refrigerant mass flow rate; Driver motor voltage; Driver motor amperage; Network communications proof; Wireless signal strength.

Similar measurements may be made by wireless sensor modules for 3-way heat reclaim valves, refrigerant flow check valves, refrigerant flow solenoid valves, oil level control valves, and oil differential pressure valves, which are employed in many commercial refrigeration systems. However, in the case of oil level control valves and oil pressure differential valves, the mass flow rate of the oil is measured as opposed to the mass flow rate of the refrigerant. In this manner, various aspects of the hydraulic circuit, not shown in FIG. 5, may be monitored for faults.

Another refrigeration system device is the receiver, such as the receiver 504 of FIG. 5. In the receiver, wireless and/or MEMs-based sensor modules similar to that of FIGS. 3 and 4 may be used to measure the following quantities: Vessel percent full; Vessel weight; Vessel temperature; Vessel pressure; Network communications proof; and wireless signal strength.

Another refrigeration system device is the refrigerant moisture indicator, such as the moisture and liquid indicator 510 of FIG. 5. In the refrigerant moisture indicator, wireless sensor modules similar to that of FIGS. 3 and 4 may be used to measure the following quantities: PPM water; Network communications proof; and wireless signal strength.

Another refrigeration system device is an acid indicator, not shown in FIG. 5 but would be known in the art. In the acid indicator, wireless and/or MEMs-based sensor modules similar to that of FIGS. 3 and 4 may be used to measure the following quantities: pH Level; pOH Level; Network communications proof; and wireless signal strength.

The various values generated by the wireless sensors in the above describe devices may be compared to baseline (reference) values to determine whether a fault exists. More or less wireless sensors may be employed by any one system.

It will be appreciated that the above described embodiments are merely exemplary, and that those of ordinary skill in the art may readily develop their own modifications and implementations that incorporate the principles of the invention and fall within the spirit and scope thereof.

We claim:

1. An arrangement for use in a refrigeration system, the refrigeration system comprising a plurality of refrigeration devices including a compressor, a condenser, at least one evaporator unit, and at least one expansion valve, the arrangement comprising:

a first microsystem including a first MEMs sensor configured to measure a first air temperature associated with a first of the plurality of refrigeration devices;

a first controller configured to generate a first actuator control signal based at least in part directly or indirectly on the first air temperature measurement;

a second microsystem including a second MEMs sensor configured to measure a second air temperature associated with a second of the plurality of refrigeration devices;

a second controller configured to generate a second actuator control signal based at least in part directly or indirectly on the second temperature measurement; and a pressure regulation device having a device input coupled to refrigerant outputs of both the first and second refrigeration devices and a device output coupled to the compressor;

a third controller configures to generate a third actuator control signal based at least in part on the first air temperature measurement and the second air temperature measurement, wherein the pressure regulation device is configured to regulate the pressure in the first and second refrigeration devices based on the third actuator control signal;

wherein the first refrigeration device comprises a first evaporator and a first expansion valve that provides refrigerant to the first evaporator and wherein the arrangement further includes a first liquid line solenoid valve operably connected to provide refrigerant to the first expansion valve, the first liquid line solenoid valve including a first actuator configured to alter an operation of the first liquid line solenoid valve based on the first actuator control signal; and wherein the second refrigeration device comprises a second evaporator and a second expansion valve that provides refrigerant to the second evaporator wherein the arrangement further includes a second liquid line solenoid valve operably connected to provide refrigerant to the second expansion valve, the second liquid line solenoid valve including a second actuator configured to alter an operation of the second liquid line solenoid valve based on the second actuator control signal.

2. The arrangement of claim 1, wherein the first actuator control signal directly affects the operation of the first refrigeration device and the second actuator control signal directly affects the operation of the second refrigeration device.

3. The arrangement of claim 1, wherein the first refrigeration device is a first evaporator unit, and the second refrigeration device is a second evaporator unit.

4. The arrangement of claim 1, wherein the first microsystem includes the first controller, and wherein the first microsystem is operable to transmit the first actuator control signal wirelessly to another device.

5. The arrangement of claim 1, wherein the first microsystem includes a wireless transmission device configured to transmit information representative of the first operational parameter measurement to the first controller.

6. The arrangement of claim 1, wherein the third actuator control signal is determined according to at least one of a median, an average, and a maximum of the first operational parameter measurement and the second operational parameter measurement.

7. The arrangement of claim 6, wherein the third actuator control signal causes the pressure regulation device to adjust the pressure in the first evaporator and the second evaporator.

8. The arrangement of claim 7, wherein the third actuator control signal is compared to the threshold which when exceeded causes the pressure regulation device to decrease the pressure in the first evaporator and the second evaporator.

9. An arrangement, comprising:

a first microsystem including a first MEMs temperature sensor configured to measure a return air temperature proximate to a first evaporator;

a first valve controller operably coupled to receive first information including the return air temperature proximate to the first evaporator from the first microsystem, and configured to control a first liquid line solenoid valve based on the first information, the first liquid line solenoid valve operably connected to provide refrigerant to an expansion valve of the first evaporator;

a second microsystem including a second MEMs temperature sensor configured to measure a discharge air temperature proximate to the first evaporator;

a second valve controller operably coupled to receive second information including the discharge air temperature proximate to the first evaporator from the second microsystem, and configured to control an evaporator pressure regulating valve based on the second information, the evaporator pressure regulating valve operably coupled to refrigerant outputs of at least the first evaporator;

a third microsystem including a third MEMS temperature sensor configured to measure a return air temperature proximate to a second evaporator;

a third valve controller operably coupled to receive third information including the return air temperature proximate to the second evaporator from the third microsystem, and configured to control a second liquid line solenoid valve based on the third information, the second liquid line solenoid valve operably connected to provide refrigerant to an expansion valve of the second evaporator, the second evaporator having a refrigerant output connected to the evaporator pressure regulating valve.

10. The arrangement of claim 9, wherein the first valve controller is operable to generate a first control signal based on the first information and a first set point.

11. The arrangement of claim 10, wherein the third valve controller is operable to generate a third control signal based on the third information and a third setpoint.

12. The arrangement of claim 11, wherein the second valve controller is configured to generate a control signal based on at least in part on the first information and the third information.

13. The arrangement of claim 12, wherein the first microsystem includes a wireless transmitter configured to transmit the first information to the first controller and to the second controller.

14. The arrangement of claim 12, wherein the control signal generated by the second valve controller is determined according to at least one of a median, average, and a maximum of the first information and the third information.

15. The arrangement of claim 9, wherein the first information comprises a valve control value, and wherein the first microsystem is operable to generate the valve control value based on the return air temperature associated with the first evaporator and a first set point.

16. The arrangement of claim 9, wherein the first microsystem includes a wireless transmitter configured to transmit the first information to the first controller.

17. The arrangement of claim 9, wherein the evaporator pressure regulating valve includes an output coupled to a compressor.

18. The arrangement of claim 9, wherein the evaporator pressure regulating valve is configured to regulate the pressure in the first evaporator and the second evaporator.

* * * * *